US005248863A

United States Patent [19]

Speraw et al.

[11] Patent Number: 5,248,863

[45] Date of Patent: Sep. 28, 1993

[54] SWITCH ACTUATOR MECHANISM

[75] Inventors: Floyd G. Speraw, Anderson; Robert W. Paterson; Ralph E. Campbell, both of Liberty, all of S.C.

[73] Assignee: NCR Corporation, Dayton, Ohio

[21] Appl. No.: 769,897

[22] Filed: Oct. 1, 1991

[51] Int. Cl.[5] ..... H01H 3/42

[52] U.S. Cl. ..... 200/573; 200/547; 200/537

[58] Field of Search ..... 200/573, 547, 551, 291, 200/331, 574, 528, 533, 542, 538, 16 C, 537, 337, 341; 74/96, 99 A, 110; 128/205.14, 205.18

[56] References Cited

U.S. PATENT DOCUMENTS

| | | | |
|---|---|---|---|
| 3,192,349 | 6/1965 | Hornberg, Jr. | 200/153 |
| 3,676,625 | 7/1972 | Blatt | 200/542 |
| 3,937,912 | 2/1976 | Martin | 200/573 |
| 3,959,618 | 5/1976 | Carroll | 200/339 |
| 4,138,603 | 2/1979 | Hudimac, Jr. | 200/153 T |
| 4,181,838 | 1/1980 | Neuser et al. | 200/573 |
| 4,280,603 | 7/1981 | Kanwar | 74/110 |
| 4,358,646 | 11/1982 | Martinez | 200/5 R |
| 4,389,551 | 6/1983 | Deibele et al. | 200/573 |
| 4,434,340 | 2/1984 | Kondo | 200/332 |
| 4,469,015 | 9/1984 | Clark | 74/110 |
| 4,616,115 | 10/1986 | Potyka | 200/573 |
| 4,731,511 | 3/1988 | Steinhilber et al. | 200/330 |
| 4,778,961 | 10/1988 | M'Sadogues et al. | 200/17 R |
| 4,857,682 | 8/1989 | Jones | 200/330 |
| 4,886,946 | 12/1989 | Franks, Jr. | 200/329 |
| 4,914,265 | 4/1990 | Mongeau | 200/330 |
| 4,972,045 | 11/1990 | Primeau | 174/66 |
| 5,021,616 | 6/1991 | Hardt | 20/43.16 |
| 5,077,454 | 12/1991 | Lorenzo | 200/573 |

*Primary Examiner*—Henry J. Recla
*Assistant Examiner*—David J. Walczak
*Attorney, Agent, or Firm*—Jack R. Penrod

[57] ABSTRACT

An actuator mechanism which is located at the front of an electronic unit and converts the push-on, push-off action of a switch to a sliding action. By converting the actuating action from an in-and-out pushing motion to a transverse sliding motion, inadvertent actuation of this switch is all but eliminated. This conversion is provided in a simple, cost effective mechanism.

3 Claims, 3 Drawing Sheets

SWITCH ACTUATOR MECHANISM

BACKGROUND OF THE INVENTION

The present invention relates to actuator mechanisms and more particularly to a slide actuator mechanism that cycles a push-on, push-off electrical switch through on and off conditions.

A push-on, push-off electrical switch has an actuator shaft which if the shaft is sufficiently moved in an axial direction and then released, the switch contacts will change their condition. Thus, if the switch is initially in an off position and the shaft is sufficiently moved in the axial direction, then the switch changes to the on position. Similarly, if the switch is initially in the on position and the shaft is sufficiently moved in the axial direction, then the switch changes to the off position After the actuating shaft is moved to change the position of the switch contacts from off to on or from on to off, the actuating shaft is released and some device within the switch, for example a spring, restores the shaft to a location for the next actuating movement.

Push-on, push-off switches are commonly used as on/off power switches for electronic units, such as computers. Such switches are typically located on the front panel of the electronic unit to provide ready access and ease of operation for the operator.

A problem arises, however, from such a location on the front panel of an electronic unit in that the operation of other front panel mounted assets can inadvertently actuate the push-on, push off switch to the off position. An inadvertent change of the power switch of a computer from the on to the off condition can cause valuable data to be lost.

Thus, it is an object of the present invention to provide a switch actuator mechanism that is not prone to inadvertent actuation.

It is another object of the present invention to provide a switch actuator mechanism to reduce the sensitivity of a push-on, push-off switch to inadvertent actuation.

It is another object of the present invention to provide a switch actuator mechanism that converts a push-on, push-off switch to a slide-on, slide-off switch.

SUMMARY OF THE INVENTION

Briefly stated, in accordance with one aspect of the invention the foregoing objects are achieved by providing a switch actuator mechanism, including push-on, push-off switch and a device for slidably actuating said push-on, push-off switch. To provide additional protection against inadvertent switch actuation, this switching mechanism can be arranged such that the actuating shaft of the push-on, push-off switch, which is moved in an axial direction to change a condition of the switch from on to off, is actuated by the slidably actuating device by sliding in a direction that is perpendicular to the axial direction of the shaft.

In another aspect of the invention, the aforementioned objects may be achieved by providing a mechanism for an electronic unit, including: a front panel having an elongated hole therein; a push-on, push-off switch mounted within the electronic unit, this switch has an actuator shaft and the switch is mounted such that the shaft is in a spaced relationship with the elongated hole in the front panel; a device for imparting a transverse motion along the elongated hole mounted behind the front panel, the transverse motion device having a portion that extends through the elongated hole; a device connected to the transverse motion device for transferring a transverse force to the shaft; and a device for converting the transverse force to an axial force for changing a condition of the switch.

Various objects appear from a reading of the foregoing summary of the invention and other objects and further scope of applicability of the present invention will appear from the following detailed description. It should be understood that the detailed description indicates exemplary embodiments of the invention and which are given by way of illustration only since changes and modifications may be made within the spirit and scope of the invention.

BRIEF DESCRIPTION OF THE DRAWINGS

While the specification concludes with the appended claims particularly pointing out and distinctly claiming the subject matter which is regarded as the invention, it is believed that the invention will be better understood from the following description taken in conjunction with the accompanying drawings in which:

DETAILED DESCRIPTION

Figure 1:
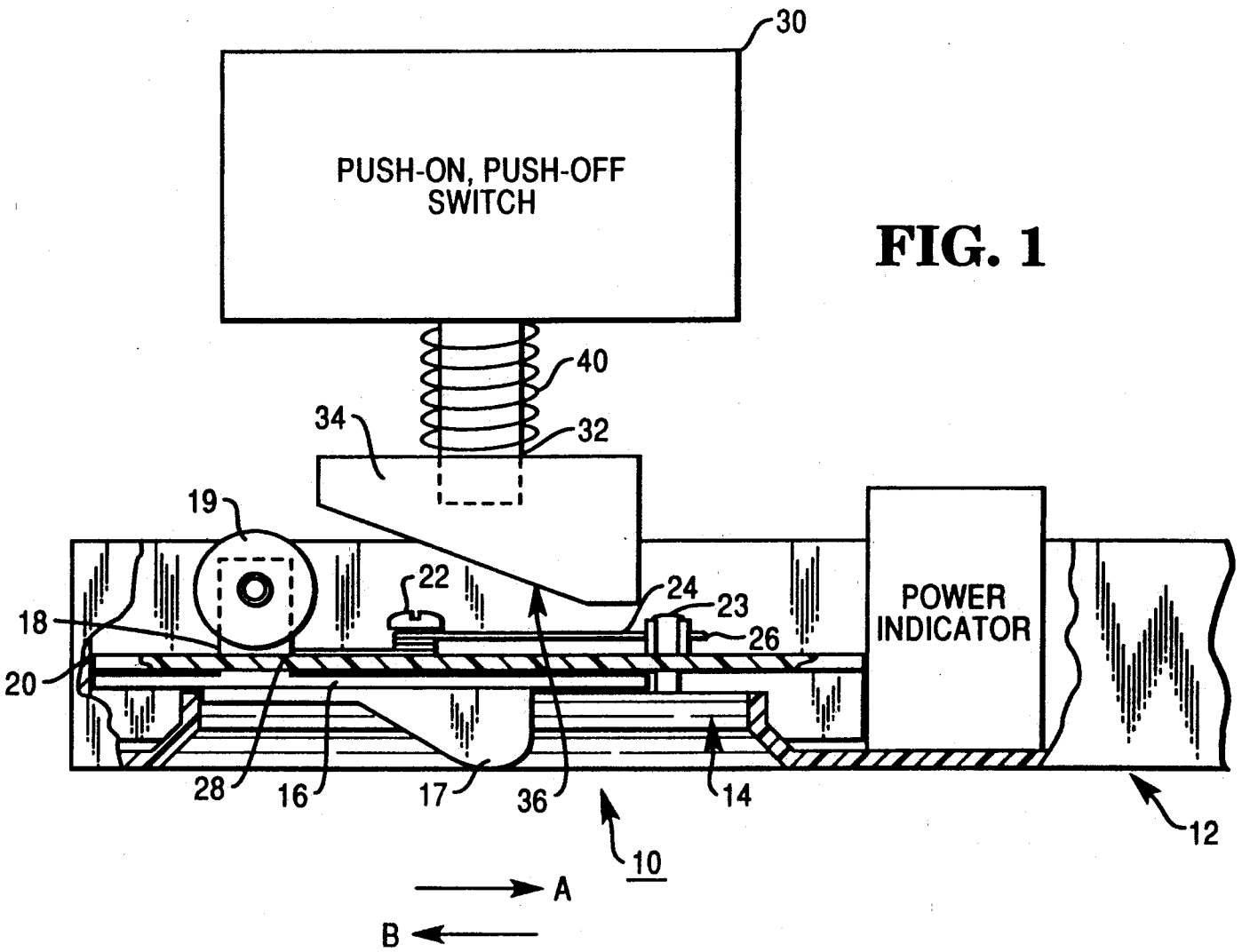
FIG. 1 is a partially broken away plan view of a electronic unit showing a push-on, push-off switch location, a switch actuator mechanism and a cross section of a front panel in accordance with one embodiment of the invention.
Figure 2:
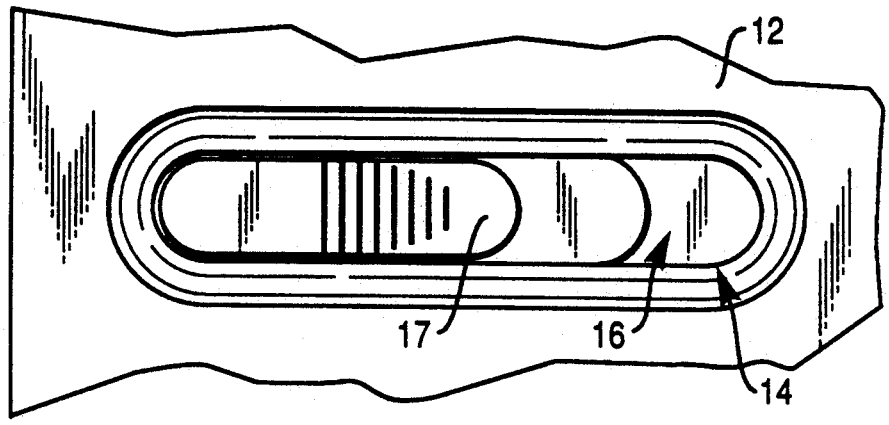
FIG. 2 is a partial front view of the electronic unit shown in FIG. 1 showing frontal details a slide member.

Referring now to FIG. 1, an electronic unit 10, such as a computer, is shown in a plan view with its top section removed to expose internal details. In addition to the section removal, the electronic unit 10 is also partially broken away to simplify the detail shown in FIG. 1. Electronic unit 10 has a front panel 12 which is shown in section. Front panel 12 has an elongated hole 14, through which a portion of slide member 16 protrudes. Referring briefly to FIG. 2, a broken away portion of the front panel 12 is shown in a front view. This front view shows elongated hole 14 with a protruding portion 17 of slide member 16 protruding therethrough.

Referring back to FIG. 1, slide member 16 also has a support member 18 protruding in an opposite direction from the protruding portion 17. Preferably, the support member 18 has a roller 19, the function of which will be explained below.

A guide plate 20 is fastened by fasteners 22, 23 and other fasteners (not shown) to guide the slide member 14. The guide plate 20 has a slot therein (not shown) to provide for passage of the support member 18 The guide plate 20 also guides the slide member 14 such that the slide member 14 travels in a direction that is substantially in parallel with front panel 12 Alternatively, upper and lower guide plates that are positioned to form a channel could be used instead of a single guide plate 20 with a slot.

Figure 3:
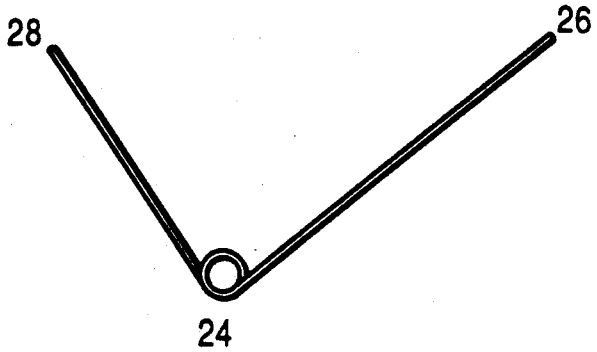
FIG. 3 is a plan view of a torsion spring such as the one shown in FIGS. 1 and 4.

Fastener 22, which may be a screw, may also secure a spring 24. Referring to FIG. 3, the spring 24 is shown as a torsion spring in this plan view. Referring back to FIG. 1, the ends 26, 28 of the spring 24 respectively bear against fastener 23 and support 18 The purpose of this spring will be explained below.

A push-on, push-off switch 30 is shown in block diagram form. The push-on, push-off switch is fastened on the inside of the electronics unit 10 in any of a number of ways, and how the switch 30 is fastened is not relevant to the present invention. The push-on, push-off switch 30 is located in a spaced relationship to the slide member 16, which is relevant to the present invention.

The push-on, push-off switch 30 has a shaft 32. This shaft 32 is the actuating part of the push-on, push-off switch 30. Assuming the switch 30 is in the off position, if the shaft 32 is pushed sufficiently to cause the condition of the switch to change, a change to the on condition occurs. Similarly, if the switch 30 is in the on position and the shaft 32 is pushed sufficiently to cause the switch 30 to change, a change to the off condition occurs.

An inclined plane member 34 is attached to the free end of the shaft 32. The inclined plane member 34 is sized such that the roller 19 bears against its surface 36 as the slide member 16 is moved in the direction A. As the roller 19 bears against the surface 36, part of the transverse pushing force is converted to a force in the axial direction of the shaft 32. This axially directed force pushes the shaft 32 inward. By sizing the roller 19, the inclined plane member 34 properly to provide sufficient displacement for the shaft 32 to cause a change of condition of the switch 30, the desired operation is achieved The switch 30 must also be located in a spaced relationship to the roller 19 to provide for sufficient interaction of the roller 19 with the inclined plane member 34 to achieve the change of condition.

With a push-on, push-off switch, usually the shaft must be extended after each condition change to prepare the switch for the next condition change. Most such switches have an internal elastic member of some type; however, if the internal elastic member does not return the shaft as necessary, an external spring 40 can be added.

Since the slide member 16 must traverse the elongated hole 14 in direction A every time to move the shaft 32 and actuate the switch 30, it would be convenient to return the slide member 16 in the direction B in preparation for the next actuation of the switch 30. In addition to convenience, returning the slide member 16 to in the direction B clears the space in front of inclined plane member 34 and allows the shaft 32 to return to the fully extended position in preparation for the next actuation. This return action is provided by the spring 24. As the slide member is pushed by the operator in direction A, spring 24 stores energy, and when the operator releases the slide member 16 spring 24 releases that energy and restores the slide member 16 to its rest position.

Figure 4:
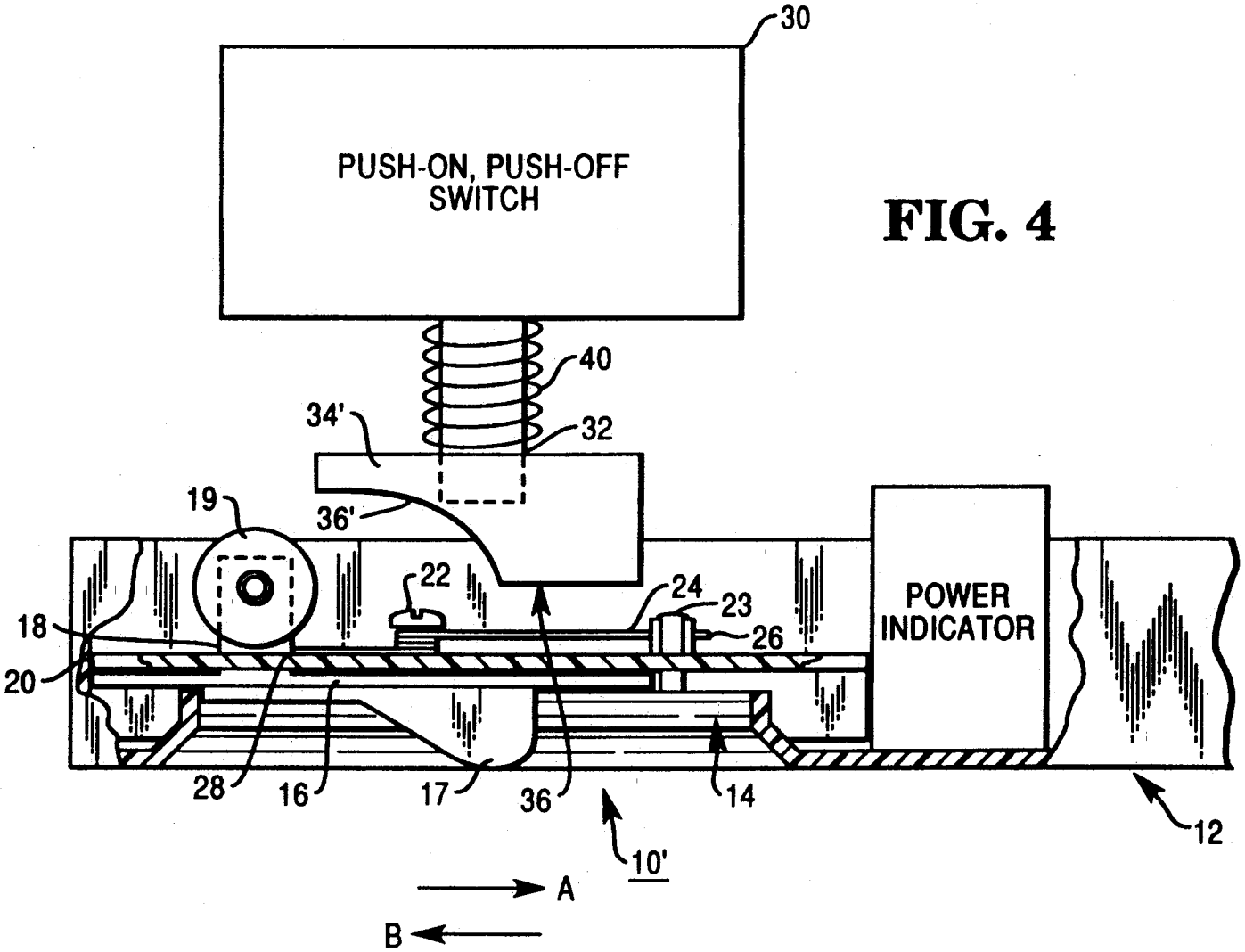
FIG. 4 is a partially broken away plan view of an electronic unit showing a push-on, push-off switch location, a switch actuator mechanism and a cross section of a front panel according to another embodiment of the invention

Referring now to FIG. 4, another embodiment of the invention is shown. The electronic unit 10' is the same as the electronic unit 10 shown in FIG. 1, except that the inclined member 34' has a curved surface 36' instead of an inclined plane surface of constant slope as the surface 36 shown in FIG. 1.

Thus, it will now be understood that there has been disclosed a switch actuator mechanism for a push-on, push-off switch. While the invention has been particularly illustrated and described with reference to preferred embodiments thereof, it will be understood by those skilled in the art that various changes in form, details, and applications may be made therein. For example, the roller can be replaced by a non-rolling protrusion, such as a rounded support, on the back of the slide member. It is accordingly intended that the appended claims shall cover all such changes in form, details and applications which do not depart from the true spirit and scope of the invention.

What is claimed as new and desired to be secured by Letters Patent of the United States is:

1. A mechanism adapted for use in an electronic unit, comprising:

a front panel having an elongated hole therein;

a push-on, push-off switch adapted to be mounted within the electronic unit;

said switch has an actuator shaft and said switch is mounted such that said shaft is in a spaced relationship with said elongated hole in said front panel;

a slide for imparting a transverse motion along said elongated hole mounted behind said front panel, said slide having a portion that extends through said elongated hole;

said portion that extends through said elongated hole is wedge-shaped for receiving force from an operator's digit;

a roller protruding from said slide for transferring a transverse force to said shaft; and means for converting said transverse force to an axial force for changing a condition of said switch.

2. A mechanism as set forth in claim 1 wherein said transverse force converting means is an inclined plane that receives a transverse force from said roller and converts said force into an axially directed force to change a condition of said switch.

3. A mechanism as set forth in claim 1 wherein: said transverse force converting means is a member that has an inclined plane portion that receives a transverse force from said roller and converts said force into an axially directed force to change a condition of said switch; and said transverse force converting means also has a non-inclined portion contiguous to said inclined portion to limit a range of motion that said shaft can be operated.

* * * * *